United States Patent [19]

Adams

[11] Patent Number: 4,774,926

[45] Date of Patent: Oct. 4, 1988

[54] SHIELDED INSULATION FOR COMBUSTION CHAMBER

[76] Inventor: Ellsworth C. Adams, 305 Roanoke, Birmingham, Mich. 48010

[21] Appl. No.: 14,905

[22] Filed: Feb. 13, 1987

[51] Int. Cl.[4] ..... F02B 75/08

[52] U.S. Cl. ..... 123/668; 123/188 AA; 123/193 C; 123/193 P; 123/193 H

[58] Field of Search ..... 123/193 R, 193 P, 193 H, 123/193 C, 657, 668, 669, 188 AA

[56] References Cited

U.S. PATENT DOCUMENTS

| | | | |
|---|---|---|---|
| 3,315,651 | 4/1967 | Dangauthier | 123/193 C |
| 4,074,671 | 2/1978 | Pennila | 123/668 |
| 4,254,621 | 3/1981 | Magumo | 123/669 |
| 4,341,826 | 7/1982 | Prewo et al. | 123/668 |
| 4,346,870 | 8/1982 | Chute et al. | 123/188 AA |
| 4,351,292 | 9/1982 | Worthen et al. | 123/188 AA |
| 4,398,527 | 8/1983 | Rynbrandt | 123/668 |
| 4,466,399 | 8/1984 | Hinz et al. | 123/668 |
| 4,530,341 | 7/1985 | Palm | 123/669 |

FOREIGN PATENT DOCUMENTS

| | | | |
|---|---|---|---|
| 792776 | 7/1902 | France | 123/668 |
| 2729230 | 1/1979 | Fed. Rep. of Germany | 123/668 |
| 3331579 | 3/1985 | Fed. Rep. of Germany | 123/668 |

*Primary Examiner*—Craig R. Feinberg
*Assistant Examiner*—M. Macy

[57] ABSTRACT

In an uncooled engine, it is propose to form insulator coatings on the combustion chamber surfaces, and to mechanically protect such coatings against erosion or cracking by means of outer protective layers applied over the insulator coatings. The insulator coatings can be zirconium oxide applied to a thickness of approximately 0.15 inch. The protective layers can be formed of various materials resistant to high temperatures in the vicinity of 2000° F., e.g. silicon nitride, steel or cast iron.

1 Claim, 1 Drawing Sheet

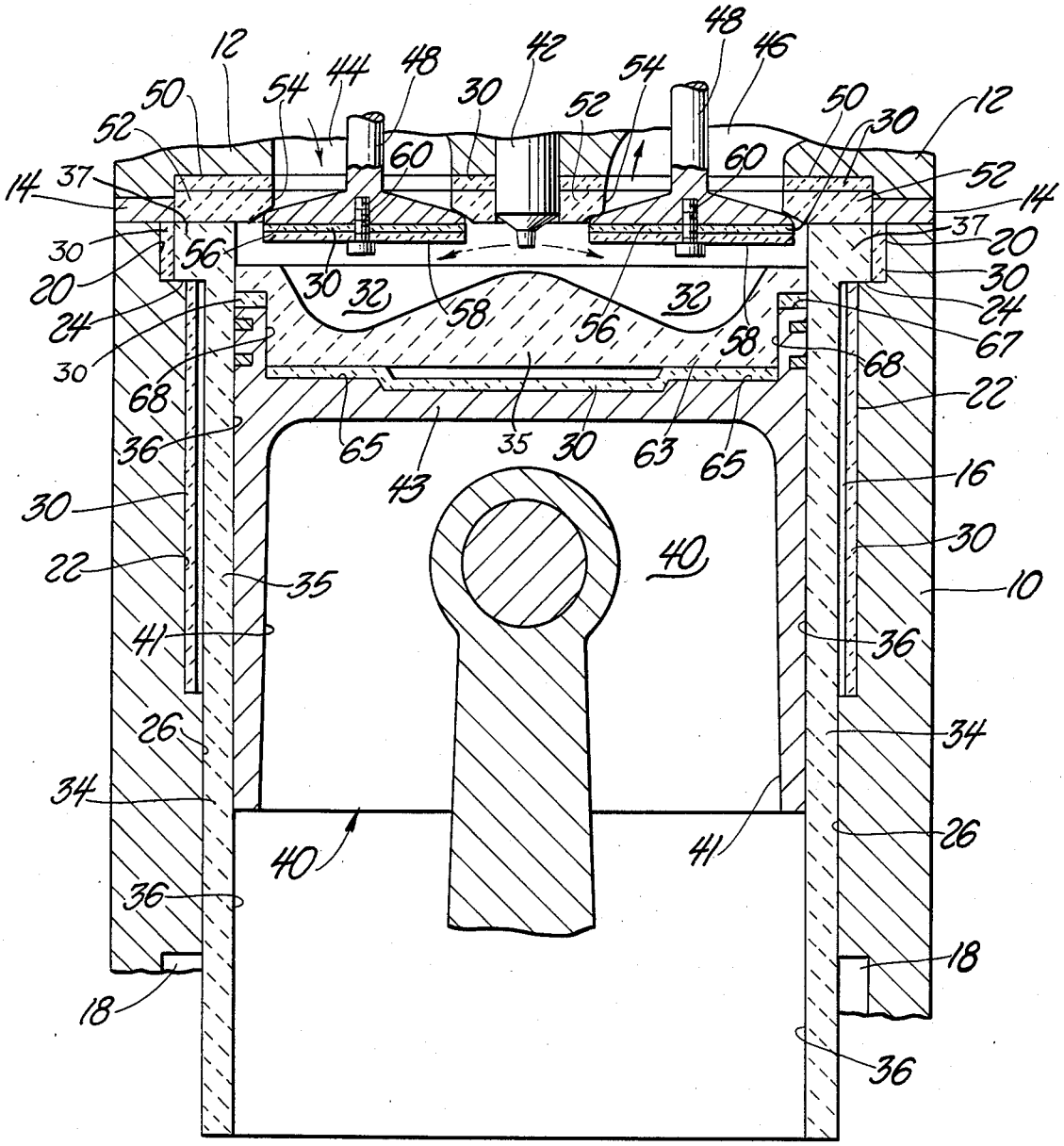
12
50
52
54
44
48
30
42
54
48
46
50
30
12
52
14
37
60
60
52
14
37
30
56
20
30
20
30
24
24
67
30
32
58
56
32
58
68
68
22
36
65
35
30
63
65
43
16
30
30
22
35
40
10
41
36
26
34
34
26
40
41
36
18
18
36

SHIELDED INSULATION FOR COMBUSTION CHAMBER

GOVERNMENT INTEREST

The invention described herein may be manufactured, used, and licensed by or for the Government for governmental purposes without payment to me of any royalty thereon.

BACKGROUND AND SUMMARY OF THE INVENTION

This invention relates to improvements in internal combustion engines of the so-called "uncooled" type. Such engines are sometimes termed low heat rejection engines. In the past such engines were termed "adiabatic" engines.

The above type engines have included insulator coatings on the combustion chamber surfaces, as shown for example in U.S. Pat. No. 4,074,671 to S. Pennila. Such coatings, have been used to reduce heat rejection from the combustion chamber into the engine walls (e.g., cylinder block and cylinder head), thereby retaining heat within the chamber for achieving an increased thermal efficiency. The insulator coatings have been applied to the chamber surfaces by the plasma spray process. Unfortunately the mechanical durability of such coatings is not entirely satisfactory when the coatings are of sufficient thickness to offer appreciable resistance to heat flow; when the coating thickness is greater than about 0.040 inch the erosion forces and high temperatures in the combustion chamber tend to cause a mechanical breakdown of the coating.

The present invention relates to mechanisms for shielding the insulator coatings from erosion forces and friction (wear) forces that occur during engine operations. The shielding mechanisms preferably take the form of separately-formed components applied to the engine surfaces after the insulator coatings have been formed on such engine surfaces.

Use of the shielding mechanisms enables thicker coatings to be applied to the engine surfaces because the coatings are no longer exposed to erosion-friction forces that tend to destruct the thicker coatings. The thicker insulator coatings provide a greater thermal insulation action, thereby making possible greater engine thermal efficiency.

The invention is used in low heat rejection diesel engines of the adiabatic type, i.e., uncooled engines that are not water-cooled or air-cooled The single FIGURE of the drawing shows one cylinder of a multi-cylinder engine embodying my invention. The other cylinders would be similarly constructed.

GENERAL ENGINE ARRANGEMENT

Engines using the invention may be either two stroke cycle engines or a four stroke cycle engines. As shown in the drawing, the engine is a generally conventional four stroke cycle diesel engine wherein a piston 40 is reciprocable back and forth in an engine cylinder 36 in accordance with step-pressure changes in combustion chamber 32. The liquid fuel is injected into combustion chamber 32 via a conventional injector 42. Combustion air is admitted to chamber 32 via an intake passage 44. In a two stroke cycle engine the combustion air would be admitted through cylinder wall ports at a time when the piston is at or near its bottom travel limit (maximum chamber volume); cylinder wall ports would also be used to exhaust products of combustion. In the illustrated engine products of combustion are exhausted from the combustion chamber through an exhaust passage 46 formed in cylinder head 12. Each passage (44 or 46) has a poppet valve 48 therein for controlling flow therethrough.

Combustion chamber 32 is a variable volume space defined by the lower surface of cylinder head 12, the upper end surface of piston 4, the interior side surface of cylinder 36, and the lower end faces of poppet valves 48. My invention contemplates that each of these surfaces will have an insulator lining thereon to retard the flow of heat from the combustion chamber into the chamber walls.

Each of the linings is a two-layer lining comprising a heat-resistant outer layer exposed to combustion chamber 32, and an insulating inner layer adhered to the respective chamber surface. Each outer layer acts as a shield to mechanically protect the associated inner layer from the destructive effects of the chamber 32 environment, principally those forces tending to crack, erode or wear the inner layer. In the drawing each inner insulator layer is often referenced by numeral 3; each outer protective layer is often referenced by numeral 35.

ENGINE CYLINDER CONSTRUCTION

The engine comprises a cylinder block 10 and cylinder head 12 of cast iron or similar high strength material. A conventional gasket 14 is positioned between the mating surfaces on the block and head. Block 10 has a bore 16 extending from gasket 14 to crank case area 18. As shown in the drawing, the upper (mouth) end of bore 16 includes a large diameter bore section 20. A somewhat smaller diameter section 22 of the bore extends downwardly from a annular shoulder 24. A still smaller diameter section 26 of the bore extends from bore section 22 to crankcase area 18.

Shoulder 24 functions as an axial support surface for an add-on cylinder 34. An annular flange 37 on cylinder 34 seats on shoulder 24 to locate and retain the cylinder in a fixed position in the cylinder block. I is not essential that cylinder flange 37 be located at the extreme upper end of cylinder 34. Flange 37 could be located at an intermediate point on the cylinder 34 length or at a point near the lower end of cylinder 34. The support shoulder 24 would be located at the appropriate point along the bore 16 length to operatively engage the flange on cylinder 34.

The illustrated bore surfaces 20 and 22 have ceramic insulator coatings 3 thereon. Each coating is applied to the associated engine surface by known conventional processes, e.g. a plasma spray coating process. The preferred wall thickness of the coating is approximately 0.15 inch. Preferably the ceramic coating is formed of zirconium oxide (sometimes referenced as zirconia), although it is believed that other ceramic materials can be employed in practice of the invention. Zirconium oxide is a preferred material because it has a thermal conductivity less than 1 BTU/hr/ft/° F. The aforementioned U.S. Pat. No. 4,074,671 references other ceramic materials having relatively low thermal conductivities, see column 2, lines 49 through 52 of the patent. It is contemplated that such materials can be plasma spray coated onto bore surfaces 2 and 22 (and other engine surfaces exposed to the combustion chamber).

As noted above, coating 30 has a preferred wall thickness of approximately 0.15 inch. However wall thicknesses as low as 0.08 inch provide significant resistance to heat flow from the combustion chamber into the engine walls, e.g., block 10. Coating thicknesses in the range 0.08 inch to 0.17 inch are believed to offer a satisfactory combination of good insulator action and reasonably economic production cost.

The insulator coatings 30 are shielded from direct exposure to the combustion chamber 32 by a cylinder 34 formed separately from the associated coatings 30. Cylinder 34 comprises an elongated hollow element having a close fit on (in) cylinder section 26. At its upper end the cylinder has an annular flange 37 dimensioned to seat on aforementioned shoulder 24, thereby preventing axial dislocation of the cy inder.

Cylinder 34 acts as a shield to protect fragile coatings 30 from cracking or fractures which have been experienced when the coatings were used as exposed combustion chamber surfaces. The outer (exposed) surface 36 of cylinder 34 serves as the side wall of combustion chamber 32. At least the upper section of cylinder 34 is subjected to high temperatures on the order of 2000° F. Additionally, cylinder surface 36 acts as a guide (slidable support) surface for piston 4. Cylinder 34 is therefore subjected to friction (erosion) forces and impact (compression) forces associated with piston side thrust loadings.

Cylinder 34 should be formed of a material having good wear (erosion) resistance and compressive strength at elevated temperatures on the order of 2000° F. Cylinder 34 is not required to have an insulator action; therefore its thermal conductivity is not a factor as regards materials selection. Cylinder 34 can be a ceramic material (e.g. silicon carbide or silicon nitride), cast iron, or steel.

CYLINDER HEAD CONSTRUCTION

The lower surface 50 of cylinder head 12 has an insulator coating 30 thereon. The preferred coating is zirconium oxide, applied to a wall thickness of about 0.15 inch. An outer protective disk 52 of silicon carbide is installed onto coating 30 to shield the coating from destructive effects of the chamber 32 environment. Preformed holes 54 in the disk form valve seats for valves 48. The disk is retained in place by reason of its engagement with the upper end of cylindrical element 34. Disk 52 cooperates with the associated coating 30 to form a two-layer insulator lining over cylinder head surface 50.

Disk 52 serves generally the same protective function as aforementioned cylinder 34, namely to shield the underlying coating 30 from direct exposure to the combustion chamber. Disk 52 is also required to perform a valve seat function. It should be made of a material having a smooth surface finish and dimensional stability at elevated temperatures. Suitable materials are ceramics (silicon carbide or silicon nitride), cast iron, or stainless steel.

POPPET VALVE CONSTRUCTION

Each poppet valve 48 is of conventional design, except that the lower surface 56 of each valve has an insulator coating 30 thereon. The preferred coating is zirconium oxide, applied by the plasma spray process to a wall thickness of about 0.15 inch. A protective disk 58 is secured over each coating 30 via one or more screw(s) 60. Disk 58 acts only as a protector for coating 30; the disk can be relatively thin while still accomplishing its protective function. Each disk 58 entirely covers the otherwise exposed face of the zirconium oxide coating to protect the coating from the destructive effects of the chamber 32 environment. Each disk 58 can be formed of a temperature-resistant ceramic, iron or stainless steel. The drawing shows the disk-securement mechanism as a screw 6. It is believed that other securement devices could be used. For example, the protective disks 58 might be formed as ceramic coatings on the zirconusm oxide surface, without use of a mechanical securement mechanism.

PISTON CONSTRUCTION

Piston 40 comprises an annular side wall 41 and upper end wall 43. The central portion of end wall 43 is recessed to accommodate a relatively thick cap component 63 formed of a temperature-resistant ceramic material (e.g. silicon nitride) or stainless steel. The upper face of component 63 may be contoured to form boundary surfaces for fuel droplets generated by injector 42. The recessed nature of wall 43 provides a central recessed end surface 65 and an outer annular non-recessed end surface 67. Each end surface 65 and 67 has a zirconium oxide coating 3 thereon. The insulator coating on annular end surface is optional. An annular air gap between surface 67 and the undersurface of cap component 63 may provide a sufficient insulator action for the piston. Cap component 63 is secured on the coated end surface of the piston via a press fit in annular piston surface 68. Component 63 acts as a protective shield for the underlying coatings 30 on piston surfaces 65 and 67 (if used).

INVENTIVE FEATURE

The invention contemplates an improved means for insulating the engine surfaces that define the combustion chamber, i.e., the cylinder head surface, the poppet valve end surfaces, piston end surface, and the cylinder bore surface. In each case the insulating means comprises a two-layer lining comprised of an outer heat-resistant layer exposed to the combustion chamber, and an inner insulating layer adhered to the respective engine surface.

Each outer layer acts as a shield or protector for the associated inner insulator layer, thereby enablinq the fragile inner insulator layer to have a greater wall thickness than has theretofore been possible. The greater wall thickness will provide an increased insulator action, with correspondingly less heat rejection into the engine walls and increased thermal efficiency. The invention has application in low heat rejection (uncooled) diesel engines.

In practicing the invention the base material for the engine components and the material for the insulating layers 30 should be selected to have approximately the same coefficient of thermal expansion. Thus, as the adhered surfaces expand or contract the integrity of the surface joint will be stressed less if the adhered materials expand/contract in unison. Zirconium oxide and cast iron have approximately the same coefficient of thermal expansion. Use of these materials in combination is recommended.

The heat-resistant outer layers 35 are not adhered to the inner insulating layers 30. Therefore, the coefficient of thermal expansion of the material for layers 35 need not be exactly the same as that for the material in layers 30. Layers 35 must be formed of a material that is resistant to high temperatures near 2000° F. Although layers 35 do not have to serve a thermal insulator function they can contribute some insulator effect without adverse effect on performance of insulating layers 3. Whatever the material used for layer 35, its resistance to heat flow will somewhat minimize the cyclic temperature changes at the interface between layers 35 and 30; layer 35 will tend to minimize thermal cycling experienced by layers 30.

I wish it to be understood that I do not desire to be limited to the exact details of construction shown and described for obvious modifications will occur to a person skilled in the art, without departing from the spirit and scope of the appended claims. For example, not all of the engine components will necessarily be insulated in the specific manner shown in the drawings. Also, in some cases the protective layers 35 may have insulator coatings thereon to enhance the insulator action.

I claim:

1. In an uncooled engine that comprises a cast iron cylindrical block (10) having a bore (16) therein, a cast iron cylinder head (12) having an inside surface facing the bore (16) whereby the bore (16) and the head surface cooperatively form a combustion chamber (32), the cylinder head (12) having an air intake passage (44) and an exhaust passage (46) communicating with the head surface; poppet valves (48) on the head (12) for opening and closing the respective passages, each poppet valve (48) having an end surface thereof exposed to the combustion chamber (32); and a piston (40) having, at the end nearer to the head surface, a cast iron end wall (43);

the improvement wherein the bore (16) includes a largest diameter bore section (20) nearest the cylinder head (12), an intermediate bore section (22) surrounding the combustion chamber (32), a shoulder between the largest diameter bore section (20) and the intermediate bore section (22) and a smallest diameter bore section (26) furthest from the cylinder head (12), the largest diameter bore section (20) and the intermediate bore section (22) only having adhered thereto a first insulative coating; there being a first heat resistant layer for covering said first insulative coating comprised of a cylinder (34) extending through the bore (16) for slideably retaining the piston (40), said cylinder (34) being in direct contact with and closely fit within the smallest diameter bore section (22) and having an annular flange (37) engaging the shoulder (24) of the bore (16);

the inside surface of the cylinder heat (12) having adhered thereto a second insulative coating and having a second heat resistant layer covering said second insulative coating, said second heat resistant layer held against said second insulative coating by the cylinder (34), the second insulative coating and the second heat resistant layer defining holes at the openings in the air intake passage (44) and the exhaust passage (46);

each end surface of the poppet valve (48) being free of flanges or ridges and having adhered thereto a third insulative coating covered by a third heat resistant layer; the third insulative coatings and the third heat resistant layers being congruent with the end surfaces;

the end wall (43) of the piston having adhered thereto a fourth insulative coating covered by fourth heat resistant layer comprising a piston cap (63);

each of the insulative coatings having a thermal expansion substantially that of cast iron and being made of zirconium oxide; and each of the heat resistant layers being exposed to combustion chamber (32) and being formed of a material resistant to cracking, erosion and wear when subjected to temperature on the order of 2000 degrees Fahrenheit and being effective to shield the respective insulative coatings from erosion and wear incident to the combustion process within the engine.

* * * * *